United States Patent [19]

Durand et al.

[11] Patent Number: 4,572,958

[45] Date of Patent: Feb. 25, 1986

[54] INFRARED IMAGER

[75] Inventors: William W. Durand, Edina; Gary R. Knowles, Arden Hills, both of Minn.

[73] Assignee: Honeywell Inc., Minneapolis, Minn.

[21] Appl. No.: 646,392

[22] Filed: Aug. 31, 1984

[51] Int. Cl.[4] ..... G01J 1/00

[52] U.S. Cl. ..... 250/495.1; 250/504 R

[58] Field of Search ..... 250/493.1, 495.1, 504 R; 313/380, 388

[56] References Cited

U.S. PATENT DOCUMENTS

| | | | |
|---|---|---|---|
| 3,227,879 | 1/1966 | Blou et al. | 250/495.1 |
| 3,764,839 | 10/1973 | Fujimura | 313/464 |
| 4,058,734 | 11/1977 | Vroombout | 250/495.1 |
| 4,240,212 | 12/1980 | Marshall et al. | 250/495.1 |
| 4,317,063 | 2/1982 | Pedder et al. | 250/333 |
| 4,346,901 | 8/1982 | Booth | 250/504 R |
| 4,386,294 | 5/1983 | Nelson | 313/388 |
| 4,422,646 | 12/1983 | Rosa | 250/495.1 |
| 4,437,035 | 5/1984 | Raverdy et al. | 313/388 |

*Primary Examiner*—Alfred E. Smith
*Assistant Examiner*—Richard Hanig
*Attorney, Agent, or Firm*—William T. Udseth

[57] ABSTRACT

Thermal energy is deposited within the body of an infrared transparent material. The thermal energy heats a radiating material which is opaque and strongly emitting over infrared wavelengths. An infrared image is then radiated from the radiating material. The thermal energy is deposited within the infrared transparent material preferably by providing a reticulated surface and scanning across an exposed portion of the thermal conductor with an electron beam or a laser.

14 Claims, 5 Drawing Figures

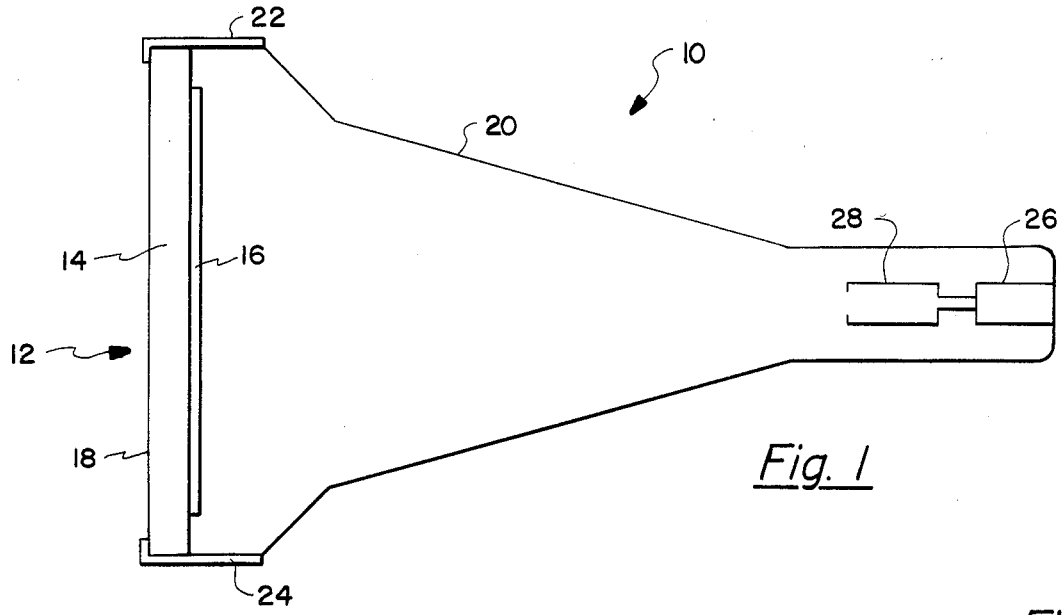
Fig. 1
Fig. 2
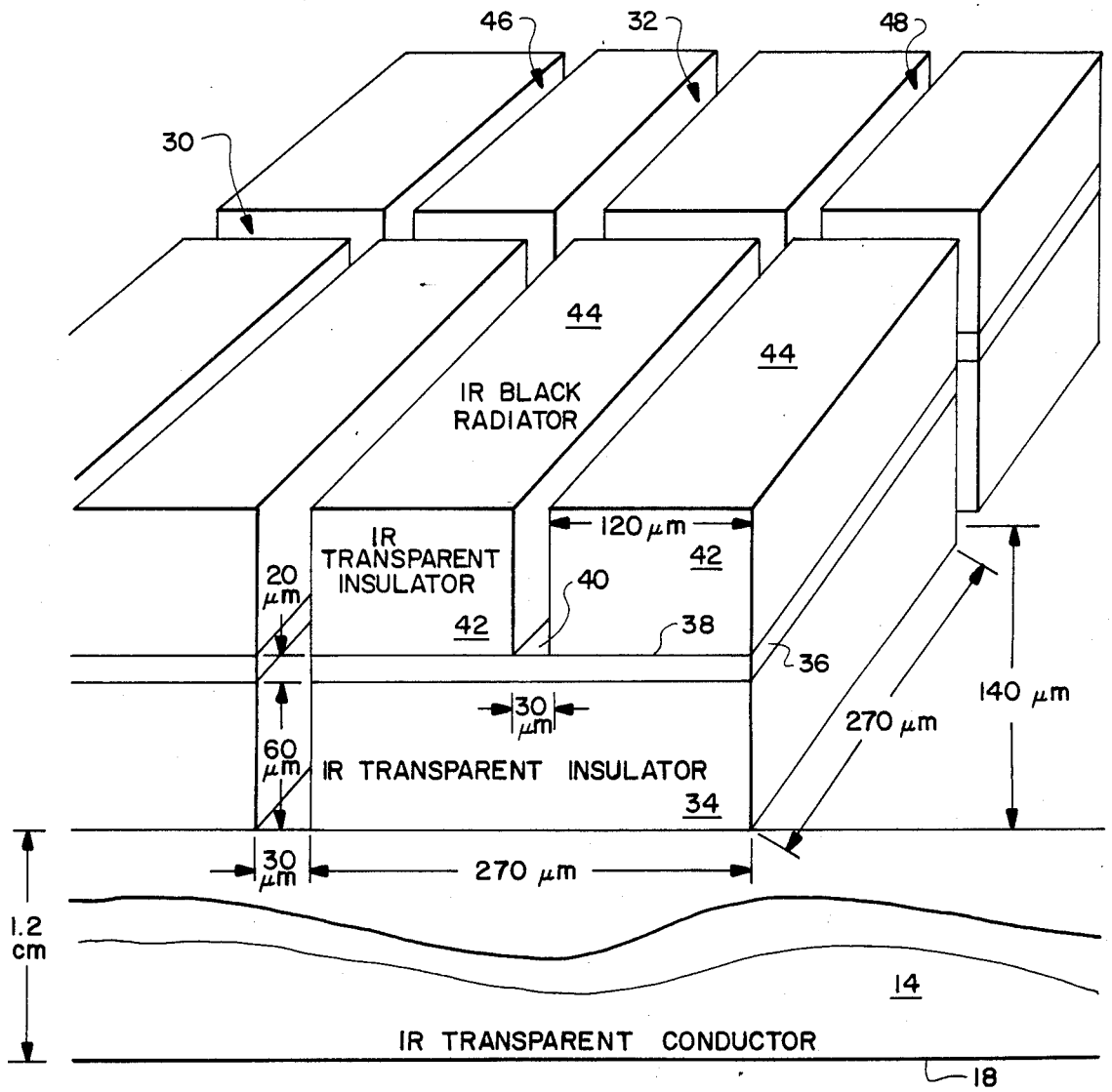

INFRARED IMAGER

BACKGROUND OF THE INVENTION

1. Field of the Invention

This invention relates to imaging devices wherein an infrared transparent thermal conductor is heated, and heat is transferred from the conductor through an infrared transparent thermal insulator to an infrared opaque radiator.

2. Prior Art

Devices for producing thermal images are shown in U.S. Pat. Nos. 3,764,839 to Fujimura and U.S. Pat. No. 4,346,901 to Booth.

Fujimura uses a cathode ray tube to heat a face plate and, in turn, heat radiative resistors. Heat sensitive paper is rolled across the radiative resistors to produce a thermal image.

In Booth, a resistive material is disposed between layers of insulation and screen like continuous electrodes. Portions of the insulation are removed at predetermined locations to expose the resistive material and the continous electrodes are fastened to the exposed resistive material. When an electrical potential is applied to the continuous electrodes, the target emits thermal radiation in order to simulate a known thermal image.

Reticulated pyroelectric targets are used to detect infrared radiation. Examples are U.S. Pat. No. 4,317,063 to Pedder, et al, U.S. Pat. No. 4,386,294 to Nelson and U.S. Pat. No. 4,437,035 to Raverdy, et al.

Reticulated pyroelectric targets are used to detect infrared radiation by exposing a signal plate to an image, heating the signal plate with electromagnetic energy from the image which in turn generates an electrical potential difference between opposite faces of the pyroelectric target. The effect of the potential difference is monitored by an electron beam which scans the pyroelectric material on the opposite face from the signal plate. By etching a number of closely spaced grooves into the pyroelectric material, thermal conduction from one spot on the pyroelectric sheet to the surrounding area is reduced thus providing greater image resolution. The technique of using these grooves is known as reticulation.

The prior art does not disclose any device which directly generates an infrared image on an image surface with high resolution and high fidelity (i.e., correlation of the visible image to the true infrared image). Such a device is highly desirable.

Presently, infrared sensor imaging systems are tested by passing an infrared sensor by an object or scene of interest and generating a magnetic tape recording from the sensor. The tape is then utilized to reproduce an electronic image in the test system. But the infrared sensor of the system under test is not tested because no infrared image is actually viewed by its sensor.

The present invention allows the same elecronic signals recorded on the magnetic tape to reproduce a high resolution, high fidelity infrared image. This infrared image can in turn be used to test the infrared sensor of an infrared imaging system.

SUMMARY OF THE INVENTION

The present invention produces an infrared image by heating a relatively thin infrared transparent thermal conductor with a heat source, such as an electron beam. The heat diffuses rapidly through the conductor and is then diffused relatively slowly to a heat radiating surface through an infrared transparent thermal insulator. The low diffusivity of the heat to the radiating surface minimizes temperature fluctuations of the radiating surface. The radiating surface is preferably opaque to infrared wavelengths of interest and strongly emitting over those wavelengths.

The invention can produce an infrared image rapidly, the image will maintain a constant radiant intensity for a known period of time and the image can be erased rapidly.

The image surface is preferably a reticulated surface with the heat source scanning the thermal conductor along grooves cut in the thermal insulator.

BRIEF DESCRIPTION OF THE DRAWING

FIG. 1 is a schematic of the present invention as incorporated in a cathode ray tube.

FIG. 2 is an enlarged, perspective view of a portion of the face plate of FIG. 1.

DESCRIPTION OF THE PREFERRED EMBODIMENT

Figure 3:
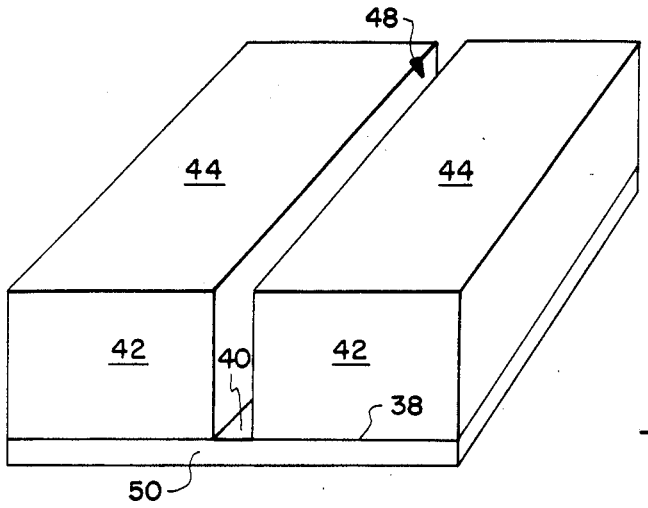
FIG. 3 is an enlarged, prespective view of an alternative embodiment of the face plate of FIG. 1.

FIG. 1 shows device 10 which incorporates the present invention. Device 10 includes a face plate 12. Face plate 12 includes substrate 14 and pixel (or cell) structure 16. An antireflection coating (typically a thin multilayer interference coating) is not shown but preferrably covers surface 18 of substrate 14. Evacuated tube 20 joins with face plate 12 to provide a hermetically sealed enclosure. Members 22 and 24 are good thermal conductors and preferably are in contact with the entire exterior edge of substrate 14. An electron gun 26 combines with deflector plates 28 to preferably provide a fast scanning electron beam source typified by a video system. Face plate 12 is a means for displaying an image which will be produced in response to an electron beam scanning the pixel structure 16.

FIG. 2 is an enlarged view of a portion of face plate 12 showing the details of the pixel structure 16. Substrate 14 is an infrared transparent thermal conductor. Pixel structure 16 is preferably provided as a reticulated structure with grooves 30 and 32 separating the pixels or cells. The pixels are preferably identically structured with FIG. 2 showing portions of four separate pixels. The pixels preferably have rectangular (including square) surfaces, but other shapes are possible.

The pixel structure begins with an infrared transparent thermal insulator layer 34 adjacent to and in contact with substrate 14. Overlying insulator 34, adjacent to it and in contact with it is infrared transparent conductor 36. The inner surface 38 of conductor 36 has a portion 40 exposed to the electron beam. The remainder of surface 38 is in contact with infrared transparent insulator 42. Adjacent to and in contact with insulator 42 is an infrared radiator 44 (typically an infrared black radiator) which is opaque to and stronging emitting over the infrared wavelengths of interest Scanning grooves 46 and 48 allow the electron beam to directly impinge on portion 40 of conductor 36.

FIG. 2 shows typical dimensions of the pixels but the dimensions are highly application dependent, and the dimensions as well as the conductivity of layers 14, 34, 36 and 42 can be optimized to minimize the power requirements and promote rapid cooling of the radiating surface 44 after a period of uniform elevated temperature. Typically the various layers will each be of uniform thickness throughout.

The thermal conductivity of layers 14 and 36 are preferably at least one hundred (100) times greater than the thermal conductivity of layers 34 and 42. If the image refresh rate is high, the thermal conductivity of layers 14 and 36 can be closer to the thermal conductivity of layers 34 and 42 than if the image refresh rate is low. Further, the higher the thermal conductivity of layers 14 and 36 as compared to the thermal conductivity of layers 34 and 42, the thinner layers 14 and 36 can be.

In operation, electron gun 26 will receive electronic signals (typically from a magnetic tape generated by passing an infrared sensor past an image which one wishes to project) which in turn will control an electron beam to scan along grooves 46 and 48 of pixel structure 16. The electrons will impact portion 40 of layer 36 and heat layer 36 as they collide with it. The heat in conductor 36 will spread laterally quickly because layer 36 is relatively thin and a good thermal conductor. At the same time, heat will diffuse relatively slowly from layer 36 to radiator 44 due to the relatively low thermal conductivity of insulator 42. The low diffusivity of heat to radiating surface 44 minimizes the temperature fluctuations of the radiating surface. With radiator 44 heated relatively uniformly, a constant radiant intensity will be provided from radiator 44 through the remainder of the pixel structure which is infrared transparent and through the infrared transparent substrate 14.

If conductor 36 is not reheated periodically, conduction through insulating layers 34 and 42 will rapidly cool radiator 44 to the temperature of substrate 14. Thus, device 10 will project a high resolution image where the image can be rapidly produced, the image will maintain a constant radiant intensity for a known period of time and the image can be erased rapidly. Note that members 22 and 24 can be placed in good thermal contact with a heat sink to enhance the rapid cooling.

The present invention discloses that infrared images can be generated by depositing thermal energy within the body of an infrared transparent medium having radiative surface areas. One structure for accomplishing this is shown in FIG. 2.

When the structure of FIG. 2 is used to enclose an evacuated chamber as in device 10, substrate 14 must be thick enough to withstand the pressure differential across it.

Device 10 is merely one example of a device which can incorporate face plate 12 as a means for displaying an image and an electron gun is merely one example of a means for heating the pixels. For certain applications, face plate 12 may be employed in a device which is not evacuated or another heating source such as a laser may be used to scan along grooves 46 and 48. Further, multiple electron guns or lasers may be employed.

FIG. 3 shows a simplified face plate structure which is expected to have more limited application than the structure of FIG. 2 but nevertheless embodies the basic concept of the invention which is the deposition of the thermal energy within an infrared transparent body. Corresponding structure between FIGS. 2 and 3 is like numbered.

The primary difference between the structures of FIGS. 2 and 3 is that only one insulator layer is employed and the conductor layers are combined in a single layer 50. Generally layer 50 will be relatively thin to enhance lateral heat diffusion and therefore the structure of FIG. 3 will not likely be employed where an evacuated chamber is utilized or at least not where there is a large pressure differential across conductor 50.

In operation, the structure of FIG. 3 functions similarly to that of FIG. 2. The electron beam or other heat source scans along groove 48 and heats portion 40 of conductor 50. The heat diffuses laterally at a rapid rate through layer 50 and then much more slowly through insulator 42 to provide a relatively constant radiant image from radiator 44.

Figure 4:
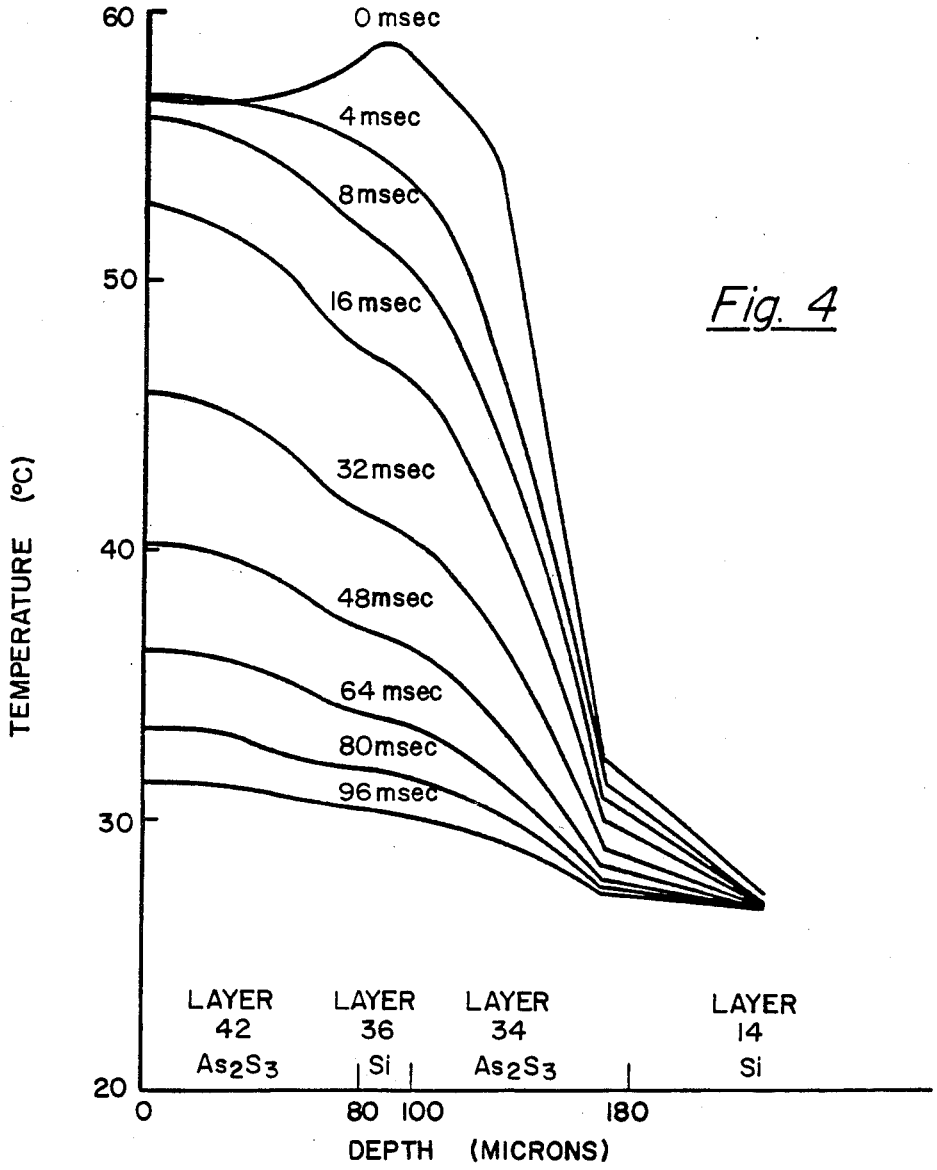
FIGS. 4 and 5 are calculated temperature decay profiles for particular face plates.
Figure 5:
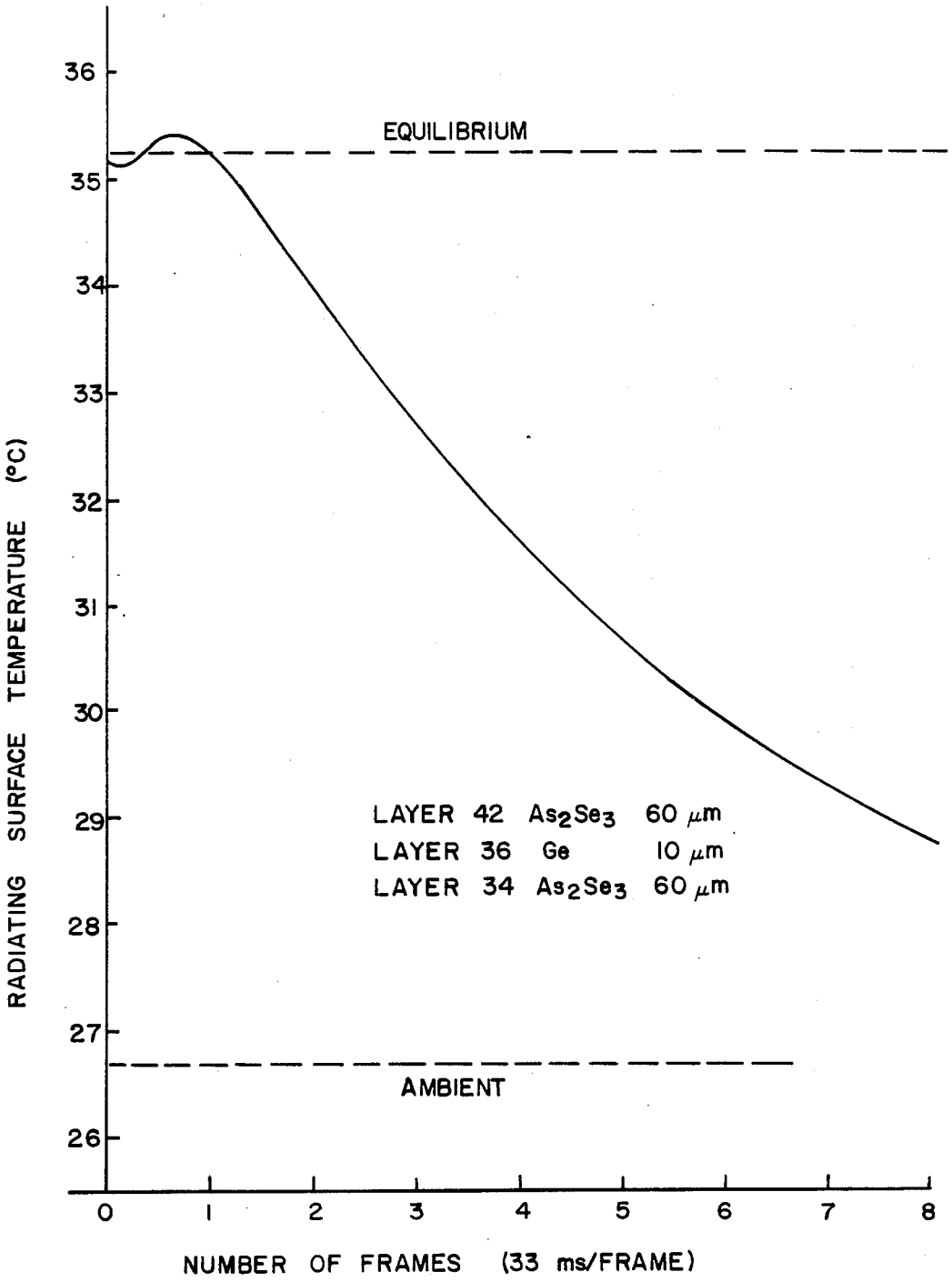

FIGS. 4 and 5 shows the results of calculations of a temperature decay profile for structures similar to that of FIG. 2. The dimensions of the various layers are shown along the abscissa of FIG. 4 as are the materials utilized for the various layers (excluding layer 44).

FIG. 5 plots the temperature of radiating surface 44 as a function of time. The materials and dimensions of layers 34, 36 and 42 are shown. The rate of cooling for the structure modeled for FIG. 5 can be increased, but this will result in a larger variation in the temperature of radiating surface 44 during the first frame time. Making insulation layers 34 and 42 thinner will have a similar effect.

FIGS. 4 and 5 show that with proper heating, the surface temperature of layer 44 (at zero microns in FIGS. 4 and 5) will remain substantially uniform for several milliseconds before rapidly cooling towards the substrate (thermal sink) temperature. Longer periods of uniform temperature can be obtained by increasing the thickness of the layers and faster cooling rates can be obtained by lowering the sink temperature.

When the present invention is utilized with a cathode ray tube, it has the additional advantage of being readily adapted for use with existing magnetic tapes generated from scanning with infrared sensors. A minimum of auxiliary equipment is needed to construct cathode ray tube devices employing the present invention such as device 10.

Some typical materials which can be used as conductors 14 and 36 are silicon (Si), germanium (Ge), zinc selenide (ZnSe) and zinc sulfide (ZnS). Layer 44 can be constructed, for example, from graphite (C). Good materials for layers 34 and 42 are arsenic trisulfide ($As_2S_3$) and arsenic triselenide ($As_2Se_3$). Generally the materials employed in the present invention, and particularly insulators 34 and 42, will not be pyroelectrics. The resolution of the image produced with the present invention can be no better than the dimensions of the pixels and thus the pixel dimensions should be selected accordingly.

The spectral characteristics of the infrared image produced by the present invention can be controlled by heating conductors 36 and 50 to a temperature sufficient to cause radiating material 44 to radiate energy of the desired spectrum.

What is claimed is:

1. A device for producing an image including infrared wavelengths, comprising:

means for displaying said image including a thermal conductor, a thermal insulator and a radiating material, wherein said conductor is adjacent to and in contact with said insulator, but wherein a portion of said conductor is not in contact with said insulator, and wherein said conductor and said insulator are substantially transparent to said wavelengths, and said radiating material is adjacent to and in contact with said insulator and is substantially opaque and strongly emitting over said wavelengths; and means for heating said portion of said conductor to a temperature sufficient to cause said radiating material to radiate said image.

2. A device for producing an image including infrared wavelengths, comprising:

means for displaying said image including a plurality of cells, each of said cells including first and second thermal conductors, first and second thermal insulators and a radiating material, wherein said first conductor is adjacent to and in contact with said first insulator, said first insulator is adjacent to and in contact with said second conductor, said second conductor is adjacent to and in contact with said second insulator but a portion of said second conductor is not in contact with said second insulator, and said radiating material is adjacent to and in contact with said second insulator, and wherein said first and second conductors, and said first and second insulators, are substantially transparent to said wavelengths, and said radiating material is substantially opaque and strongly emitting over said wavelengths; and means for heating said portion of said second conductor to a temperature sufficient to cause said radiating material to radiate said image.

3. The device of claim 2 further including a housing forming a hermetically sealed enclosure with at least a part of said means for displaying said image and being integral with said heating means.

4. The device of claim 2 wherein said first and second insulators, said first and second conductors and said radiating material comprise layers wherein each layer has a substantially uniform thickness throughout.

5. The device of claim 2 wherein said first and second insulators are selected from the group consisting of arsenic trisulfide ($As_2S_3$) and arsenic triselenide ($As_2Se_3$), said first and second conductors are selected from the group consisting of silicon (Si), germanium (Ge), zinc selenide (ZnSe) and zinc sulfide (ZnS), and said radiating material is comprised of an infrared black radiator.

6. The device of claim 2 wherein said heating means comprises an electron beam generator.

7. The device of claim 6 wherein said second insulator includes a first groove exposing said portion of said second conductor; and said electron beam generator is adapted to scan along said groove.

8. The device of claim 2 wherein said heating means comprises a laser.

9. The device of claim 8 wherein said second insulator includes a grove exposing said portion of said second conductor; and said laser is adapted to scan along said grove.

10. The device of claim 7 wherein said cells are separated from adjacent cells by a second groove extending through said radiating material, said second conductor and said first and second insulators.

11. A device for producing an image including infrared wavelengths, comprising:

means for displaying said image including a thermal conductor, thermal insulator and a radiating material, wherein said conductor is adjacent to and in contact with said insulator but a portion of said conductor is not in contact with said insulator, said conductor and said insulator are substantially transparent to said wavelengths, said insulator is not a pyroelectric material, and wherein said radiating material is adjacent to and in contact with said insulator, and is substantially opaque and strongly emitting over said wavelengths; and means for heating said portion of said conductor to a temperature sufficient to cause said radiating material to radiate said image.

12. A device for producing an image including infrared wavelengths, comprising:

means for displaying said image including a plurality of cells, each cell having first and second thermal conductors, first and second thermal insulators and a radiating material, wherein said first conductor is adjacent to and in contact with said first insulator, said first insulator is adjacent to and in contact with said second conductor, said second conductor is adjacent to and in contact with said second insulator but a portion of said second conductor is not in contact with said second insulator, and said radiating material is adjacent to and in contact with said second insulator, and wherein said first and second conductors, and said first and second insulators are substantially transparent to said wavelengths, said first and second insulators are not pyroelectric materials and said radiating material is substantially opaque and strongly emitting over said wavelengths; and means for heating said portion of said second conductor to a temperature sufficient to cause said radiating material to radiate said image.

13. A method of providing an image including infrared wavelengths, comprising:

heating a thermal conductor, said thermal conductor comprising a material substantially transparent to said wavelengths;

transmitting heat from said thermal conductor through a thermal insulator to a radiating material, said thermal insulator being adjacent to and in contact with said conductor and substantially transparent to said wavelengths, and said radiating material being opaque to and strongly emitting over said wavelengths; and radiating said wavelengths from said radiating material.

14. The method of claim 13 wherein said heating includes the steps of:

generating a beam of electrons; and scanning said electron beam along a portion of said thermal conductor without scanning said electron beam across said thermal insulator.

* * * * *